US011014101B2

(12) United States Patent
Zhuo et al.

(10) Patent No.: US 11,014,101 B2
(45) Date of Patent: May 25, 2021

(54) SHOWER

(71) Applicant: XIAMEN SOLEX HIGH-TECH INDUSTRIES CO., LTD., Fujian (CN)

(72) Inventors: Zhiwei Zhuo, Fujian (CN); Yonghui Zhang, Fujian (CN); Tianming Wang, Fujian (CN); Fengde Lin, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 156 days.

(21) Appl. No.: 16/109,104

(22) Filed: Aug. 22, 2018

(65) Prior Publication Data

US 2019/0176169 A1 Jun. 13, 2019

(30) Foreign Application Priority Data

Dec. 11, 2017 (CN) ..... 201711306567.1

(51) Int. Cl.

| | |
|---|---|
| ***B05B 1/18*** | (2006.01) |
| ***B05B 15/522*** | (2018.01) |
| ***E03C 1/04*** | (2006.01) |
| *B05B 3/04* | (2006.01) |
| *B05B 1/08* | (2006.01) |

(52) U.S. Cl.

CPC ..... *B05B 1/185* (2013.01); *B05B 1/18* (2013.01); *B05B 15/5225* (2018.02); *E03C 1/0408* (2013.01); *B05B 1/083* (2013.01); *B05B 3/04* (2013.01)

(58) Field of Classification Search

CPC ..... B05B 1/185; B05B 15/5225; B05B 1/18; B05B 1/083; B05B 3/04; E03C 1/0408

USPC ..... 239/556

See application file for complete search history.

(56) References Cited

U.S. PATENT DOCUMENTS

| | | | | |
|---|---|---|---|---|
| 2,878,066 A * | 3/1959 | Erwin | B05B 3/04 | 239/381 |
| 3,762,648 A * | 10/1973 | Deines | B05B 1/1636 | 239/381 |
| 3,801,019 A * | 4/1974 | Trenary | B05B 1/1636 | 239/381 |
| 3,806,033 A * | 4/1974 | Daugherty | B05B 3/04 | 239/222.21 |
| 7,278,591 B2 * | 10/2007 | Clearman | B05B 3/008 | 239/380 |

* cited by examiner

*Primary Examiner* — Chee-Chong Lee

(74) *Attorney, Agent, or Firm* — Cooper Legal Group, LLC

(57) ABSTRACT

A shower includes a fixed portion with a water outlet chamber. The fixed portion has a cover portion with a plurality of spouts for connecting to the water outlet chamber, and a movable portion including an operating member and a driving mechanism. The driving mechanism is drivingly connected to the movable portion and drives the movable portion to circulate, the movable portion is movably arranged in the fixed portion and comprises a movable plate and a plurality of protruding portion protruding on the movable plate, the protruding portion is inserted into the spout and there is a gap between the protruding portion and the spout, the operating member is drivingly connected with the movable portion and is driven by the operating member to move at least between the first position and the second position, and the movable portion discharges water differently in the first position and the second position.

14 Claims, 8 Drawing Sheets

SHOWER

TECHNICAL FIELD

The present invention relates to a sanitary product, and more particularly to a shower.

BACKGROUND TECHNIQUE

A conventional shower includes a fixing portion provided with a water outlet chamber and a plurality of water diversion chambers, and a switching mechanism is disposed between the water diversion chambers and the water outlet chamber. The fixing portion has a cover portion. The cover portion has a plurality of water spouts which can be connected with the water outlet chamber, all the water spouts are divided into a plurality of regions, the plurality of regions and the plurality of water diversion chambers are corresponded to each other, and the different water outlet chambers generally discharge different functional water. By switching the switching mechanism to make different water diversion chamber connect to the water outlet chamber, so that the spout of the area corresponding to the water diversion chamber discharge water, in order to achieve water switching function. It has the following deficiencies: First, the water chamber, a plurality of water diversion chambers and switching mechanism are all arranged, resulting in a complex internal structure. Second, the spout corresponding to different regions discharge different functional water, only the spout of the corresponding area discharge water, the spout of other area does not discharge water, the discharge water area is small.

SUMMARY OF THE INVENTION

The present invention provides a shower that overcomes the deficiencies present in the shower of the background art. The first technical solution adopted by the present invention for solving the technical problem is that:

A shower comprising a fixed portion having a water outlet chamber, said fixed portion has a cover portion having a plurality of spouts for connecting to said water outlet chamber, comprising a movable portion, an operating member and a driving mechanism, the driving mechanism is in driving connection with the movable portion and drives the movable portion to circulate, the movable portion is movably arranged in the fixed portion and comprises a movable plate and a plurality of protruding portions protruding on the movable plate, the protruding portion is inserted into the spout and there is a gap between the protruding portion and the spout, the operating member is drivingly connected with the movable portion and the movable portion is driven by the operating member to move at least between the first position and the second position, and when the movable portion is in the first position or the second position, the spout discharges different functional water.

In an embodiment, the circulatory activity of the movable portion at least comprises rotation and movement of the movable portion around an eccentric position, and the protruding portion rotates relative to a midline of the spout.

In an embodiment, the driving mechanism comprises a cam rotatable relative to the fixed portion, the movable plate is provided with a matching hole adapted to be sleeved on the cam, the operating member drives the movable portion to slide up and down along the cam between the first position and the second position.

In an embodiment, the protruding portions are tapered structures (e.g., conical structures) comprising large heads and small tails.

In an embodiment, the spout has a peripheral wall protruding from the back surface of the cover portion, an upper port of the peripheral wall forms a first water inlet for connecting the water outlet chamber, the peripheral wall is provided with a second water inlet connecting to the water outlet chamber; the protruding portion is inserted into the peripheral wall, and the movable plate at the first position covers the first water inlet.

In an embodiment, the upper port of the spout forms a first water inlet connecting to the water outlet chamber, and the spout is provided with a second water inlet which is oblique water hole capable of connecting to the water outlet chamber; the protruding portion is inserted into the peripheral wall, and the movable plate in the first position covers the first water inlet.

In an embodiment, the driving mechanism adopts a hydraulically driven driving mechanism.

In an embodiment, the fixing portion is provided with a water inlet passage for connecting the water outlet chamber, and the driving mechanism is connected between the water inlet passage and the water outlet chamber.

In an embodiment, the operating member comprises a button slidably connected to the fixed portion, and an automatic ballpoint pen mechanism is disposed between the button and the movable portion.

In an embodiment, the button is disposed at the center of the cover portion.

In an embodiment, the fixing portion further comprises a back cover portion, the back cover portion and the cover portion are relatively tightly fixed to each other, and the back cover portion and the cover portion form the above-mentioned water outlet chamber.

The second technical solution adopted by the present invention for solving the technical problem is that:

A shower comprising a fixed portion having a water outlet chamber, said fixed portion has a cover portion having a plurality of spouts for connecting to said water outlet chamber, wherein comprising a movable portion and an operating member, the movable portion is movably disposed in the fixed portion and includes a movable plate and a plurality of protruding portions protruding from the movable plate, the protruding portion is inserted into the spout and there is a gap between the spout and the protruding portion, and the operating member and the movable portion are drivingly connected and the movable portion is driven by the operating member to move at least between the first position and the second position; the spout has a peripheral wall protruding from the back of the cover portion, an upper port of the peripheral wall forms a first water inlet for connecting water outlet chamber, a second water inlet which can be connected with the water outlet chamber is arranged on the peripheral wall, the protruding portion is inserted into the peripheral wall, and the movable plate in the first position covers the first water inlet.

The third technical solution adopted by the present invention for solving the technical problem is that:

A shower comprising a fixed portion having a water outlet chamber, the fixed portion has a cover portion having a plurality of water spouts capable of connecting to the water outlet chamber, wherein comprising a movable portion and an operating member, the movable portion is movably disposed in the fixed portion and includes a movable plate and a plurality of protruding portions protruding from the movable plate, the protruding portion is inserted into the spout and there is a gap between the spout and the protruding portion, and the operating member and the movable portion are drivingly connected and the movable portion is driven by the operating member to move at least between the first position and the second position; the upper port of the spout constitutes a first water inlet connected to the water outlet chamber, and the spout is provided with a second water inlet which is oblique water hole capable of connecting to the water outlet chamber; the protruding portion is inserted into the peripheral wall, and the movable plate located at the first position covers the first water inlet.

The fourth technical solution adopted by the present invention for solving the technical problem is that:

A shower, comprising a fixed portion having a water outlet chamber, the fixed portion has a cover portion having a plurality of spouts which are capable of being connected to a water outlet chamber, and wherein comprising a movable portion and a driving mechanism, the movable portion is movably disposed in the fixed portion and includes a movable plate and a plurality of protruding portions protruding from the movable plate, the protruding portion is inserted into the spout and there is a gap between the spout and the protruding portion, the driving mechanism is drivingly connected to the movable portion and drives the movable portion to circulate, the circulatory activity of the movable portion at least comprises rotation and movement of the movable portion around an eccentric position, and the protruding portion rotates relative to a midline of the spout.

Compared with the background art, the technical solutions have the following advantages:

The utility model also comprises a movable portion, an operating member and a driving mechanism. The driving mechanism is in driving connection with the movable portion and drives the movable portion to circulate. The movable portion is arranged in the fixed portion and comprises a movable plate and a plurality of protruding portions protruding on the movable plate. The spout is inserted into the spout and there is a gap between the spout and the protruding portion, the operating member is drivingly connected with the movable portion and the movable portion is driven by the operating member to move at least between the first position and the second position, when in the first position or the second, the movable portion discharge different functional water, when both in the first position and in the second position, the movable portion discharge water, the water area is large. The protruding portion of the movable portion moves regularly inside the spout to prevent fouling of the spout.

The cyclic activity of the movable portion includes at least the rotation and movement of the movable portion about the eccentric position, the protruding portion rotates relative to the middle of the spout, the protruding portion can agitate the water flow, and the discharge water massage effect is good so as to prevent the fouling and clogging of the spout.

The protruding portion has a tapered structure with a large head and a small tail (e.g., narrowing from an upper portion of the protruding portion to a bottom portion of the protruding portion), the discharge water massage is better.

The operating element comprises a button which can be slidably connected with the fixed portion, an automatic ballpoint pen mechanism is arranged between the button and the movable portion, the structure is simple and compact.

Button is located in the middle portion of the cover, it is easy to press.

The peripheral wall is provided with a second water inlet which can be connected with the water outlet chamber, the protruding portion is inserted into the peripheral wall and the movable plate at the first position covers the first water inlet, or the spout is provided with a second water inlet which is oblique water hole connecting to the water outlet chamber, the protruding portion is inserted into the peripheral wall and the movable plate located at the first position covers the first water inlet, and the shower can generate granular water or shake the shower water.

The cyclic activity of the movable portion includes at least the rotation and movement of the movable portion about the eccentric position, and the protruding portion rotates relative to the middle of the spout. The protruding portion can agitate the flow of water. The effect of the discharge water massage is good and prevents fouling and clogging of the spout.

BRIEF DESCRIPTION OF THE DRAWINGS

The present invention will be further described below with reference to the accompanying drawings and embodiments.

DETAILED DESCRIPTION

Figure 1:
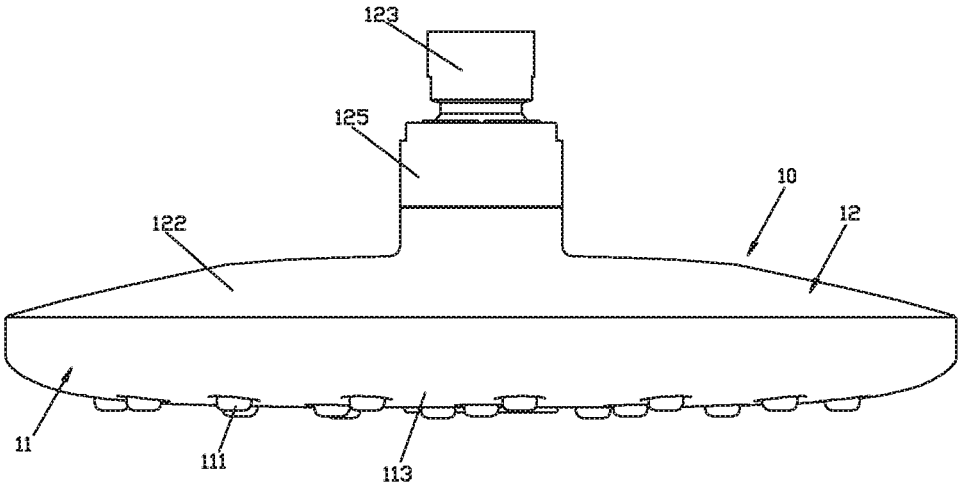
FIG. 1 is a three-dimensional schematic view of the shower.
Figure 2:
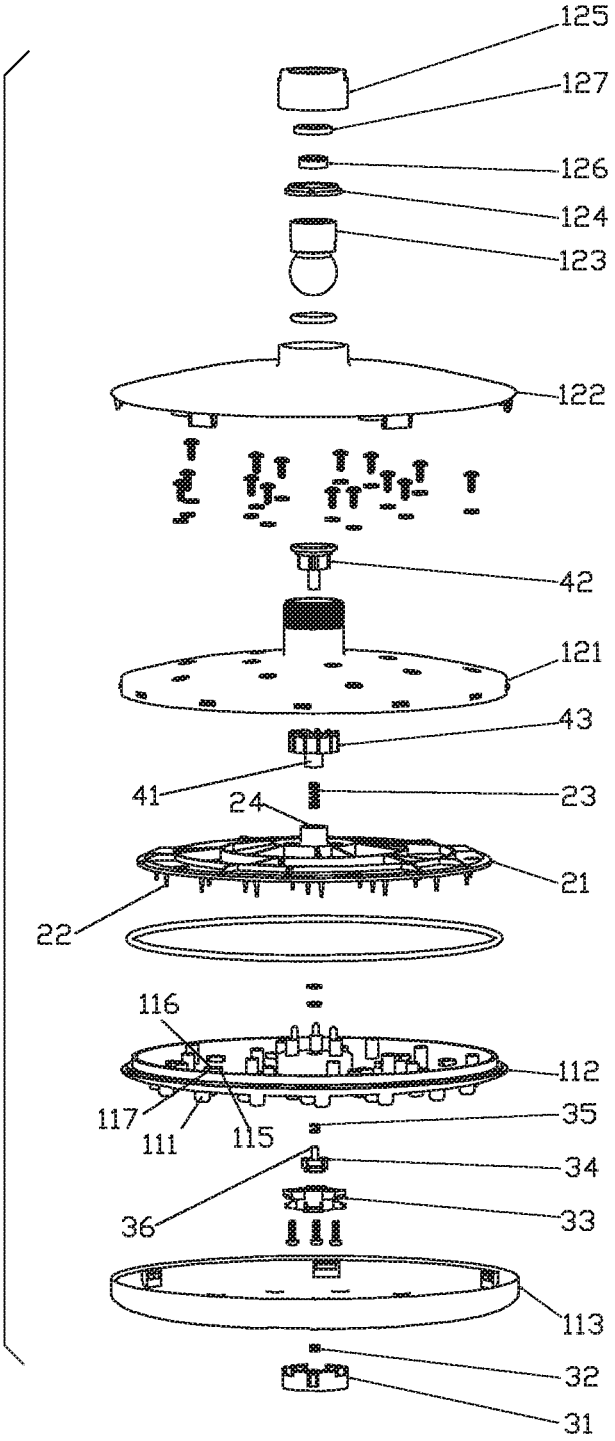
FIG. 2 is a three-dimensional exploded view of the shower.
Figure 3:
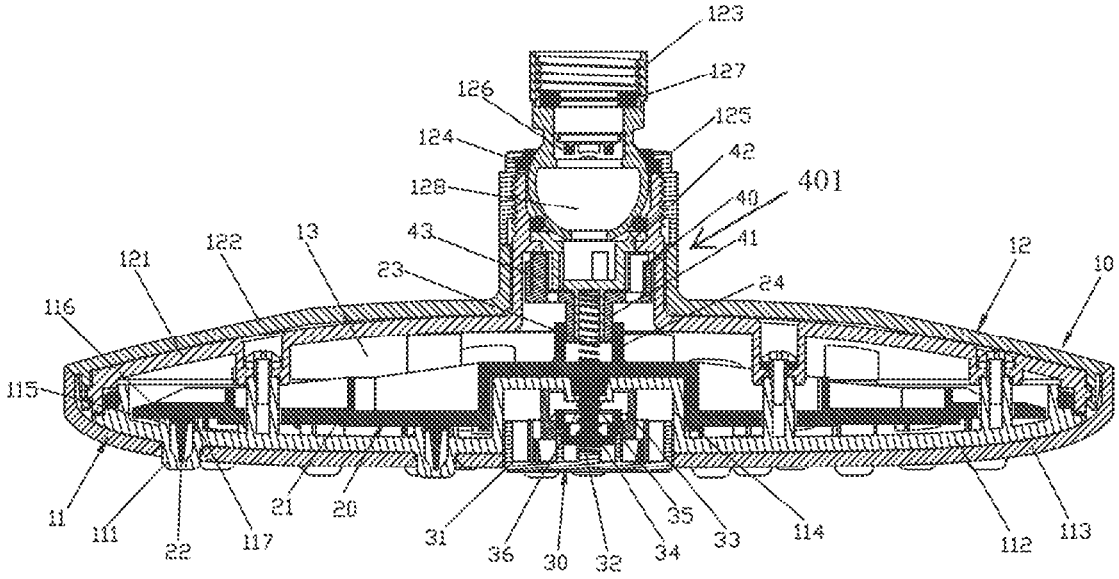
FIG. 3 is a cross-sectional view of the shower, when the movable portion is in the first position.

Please refer to FIG. 1 to FIG. 10, the shower includes a fixed portion 10, a movable portion 20, an operating member 30 and a driving mechanism 40.

The fixed portion 10 includes a cover portion 11 and a back cover portion 12. The cover portion 11 and the back cover portion 12 are relatively tightly fixedly connected with each other, and a water outlet chamber 13 is formed between the cover portion 11 and the back cover portion 12. The cover portion 11 has a plurality of spouts 111 capable of connecting with the water outlet chamber 13. The cover portion 11 includes a water outlet cover 112 and a decorative cover 113 stacked on the front surface of the water outlet cover 112. The stack-up fixture uses, for example, an adhesive structure or other fixed structure that is not removable or detachable; the water outlet cover 112 is provided with the spout 111, the decorative cover 113 is provided with a plurality of through holes penetrating up and down, and the water outlet cover 112 of the plurality of spouts 111 is adapted to extend into the through hole and extend the front surface of the decorative cover 113. The back cover portion 12 includes a back cover 121 and a main body 122 stacked on the back of the back cover 121. The back cover portion 12 is provided with a water inlet passage 128. In the present embodiment, the water outlet cover 112 and the back cover 121 are fixedly connected by a screw, and a sealing ring is arranged between the water outlet cover 112 and the back cover 121. The main body 122 is convexly provided with a ring, the ring and the back cover 121 are fixedly connected by a buckle structure; the back cover portion 12 can be connected to the water supply source through the ball joint 123, the bushing 124 and the nut 125 and lead the water of the water supply source into the shower, and the water inlet passage 128 connects the water supply source and the water outlet chambers 13; a water-stop 126 and a filter spacer 127 may also be provided in the ball joint 123 as required.

The movable portion 20 is movably disposed in the water outlet chamber 13 of the fixed portion 10 and includes a movable plate 21 and a plurality of protruding portions 22 protruding from the front surface of the movable plate 21. The protruding portion 22 is a conical structure with a large head 221 and a small tail 222. The operating member 30 is movably disposed on the fixed portion 10, and the operating member 30 drivingly connects to the movable portion 20, and the operating member 30 drives the movable portion 20 to move between the first position and the second position. Whether in the first position or the second position, the protruding portion 22 is inserted into the spout 111 and there is a gap between the spout 111 and the protruding portion 22 for the flow of water. The driving mechanism 40 adopts a hydraulically driven driving mechanism 401 mounted between the water inlet passage 128 and the water outlet chamber 13. The driving mechanism 40 drivingly connects to the movable portion 20 and drives the movable portion 20 to move in cycle. The circulating movement includes at least the rotation and movement of the movable portion 20 about the eccentric position, and the protruding portion 22 rotates relative to the midline of the spout 111, for example, the axis of spout 111. The movable portion 20 is drivingly connected to the driving mechanism 40 regardless of whether the movable portion 20 is in the first position or the second position, and the shower discharges different functional water when the movable portion 20 is in the first position and the second position.

The operating member 30 includes a button 31 slidably connected to the fixed portion 10. An automatic ball-point pen mechanism is disposed between the button 31 and the movable portion 20. The button 31 is disposed at a middle position of the cover portion 11, for example. In the specific structure, a concave groove 114 is recessed in the center of the front surface of the water outlet cover 112, and the decorative cover 113 is provided with a through hole and the through hole is aligned with the notch of the concave groove 114 to form a sliding groove. The button 31 is adapted to be connected to the sliding groove to slide up and down relative to the cover portion 11. The automatic ballpoint pen mechanism comprises a first spring 32, a guide sliding shell 33, a ratchet shaft 34 and a second spring 35, and the guide sliding shell 33 is fixedly connected to the water outlet cover 112. The ratchet shaft 34 is arranged in the guide sliding shell 33. The first spring 32 abuts against between the ratchet shaft 34 and the button 31. The second spring 35 abuts against between the ratchet shaft 34 and the bottom of the concave groove 114. The back of the button 31, the guide sliding shell 33, the ratchet shaft 34 are provided with ratchet teeth and cooperate with each other so that they cooperate to form an automatic ballpoint pen mechanism; the ratchet shaft 34 is provided with an abutting column 36, which extends into water outlet chamber 13 from top to bottom and is drivingly connected with the movable plate 21, a sealing ring is arranged between the abutting column 36 and the water outlet cover 112, a abutting spring 23 is provided between the movable portion 20 and the back cover portion 12, the abutting spring 23, for example, against between the back of the movable plate 21 and oblique water body 42. The driving connection may not need to use the abutting structure in the embodiment, other structures may be used directly. Other structures may save the abutting spring. Pressing the button 31 causes the abutting column 36 to move upwards by an automatic ballpoint pen mechanism. The upward abutment of the abutting column 36 against the movable portion 20 moves the movable portion 20 upward from the first position to the second position, and the abutting spring 23 is in a compressed state; when the button 31 is pressed again, the button 31 is moved downward by the automatic ball-point pen mechanism to reset, the movable portion 20 moves downwards from the second position to the first position under the elastic force of the abutting spring 23.

The driving mechanism 40 includes a cam 41 capable of rotating relative to the fixed portion 10. The movable portion 20 is provided with a mating hole 24. The mating hole 24 is adapted to be sleeved on the cam 41, and the rotation of the cam 41 drives the movable portion 20 to move or rotate about the eccentricity position (e.g., the cam 41 rotates eccentrically to abut an inner wall of the mating hole 24 intermittently to drive the movable portion 20 to rotate or to move). According to the need, it can also use other structures to achieve the above trajectory, such as eccentric shaft mechanism (e.g., existing techniques). Wherein the first position and the second position of the movable portion 20 are spaced up and down along the rotation axis of the cam 41 and the cam 41 can not only drive the movable portion to circulate but also guide the moving of the movable portion 20 between the first position and the second position. The specific structure of the driving mechanism 40, for example, further includes an oblique water body 42 and an impeller 43. The oblique water body 42 includes a cup body 421 and a ring flange 422 extending outwardly from the upper periphery of the cup body 421. The cup wall of the cup body 421 is provided with an oblique water hole 423. The ring flange 422 is fixedly connected with the back cover portion 12, and the oblique water body 42 is connected with the water inlet passage 128 and the water outlet chamber 13. The impeller 43 comprises an impeller portion 431 and a cam 41 fixed below the impeller portion 431. The impeller 43 is sleeved outside the cup body of the oblique water body 42; when the water inlet passage 128 enters the water, the water flows out of the oblique water hole to impact the impeller to rotate the impeller 43, which drives the rotation of the cam 41; wherein: a fixed shaft 424 is convexly arranged under the oblique water body, and the cam is adapted to rotate and be sleeved outside the fixed shaft. The oblique water body 42 and the impeller 43 comprising the cam 41 define the hydraulically driven driving mechanism 401.

Figure 4:
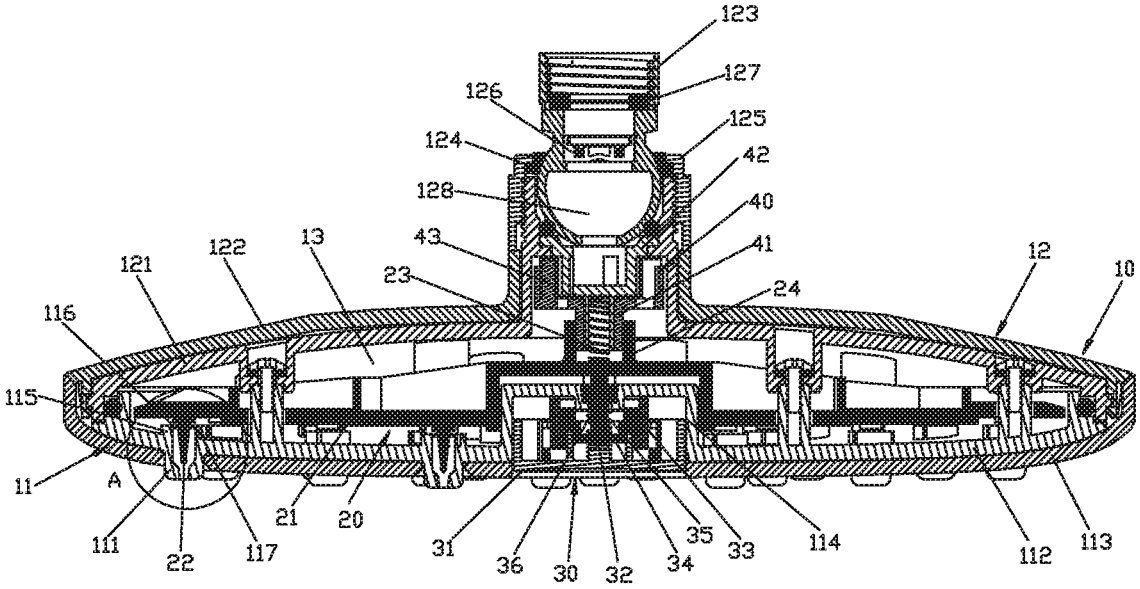
FIG. 4 is a cross-sectional view of the shower, when the movable portion in the second position.
Figure 5:
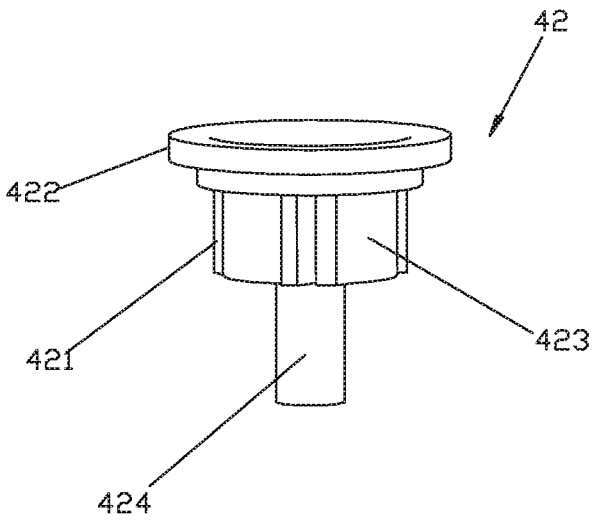
FIG. 5 is the three-dimensional schematic view of the oblique water body.
Figure 6:
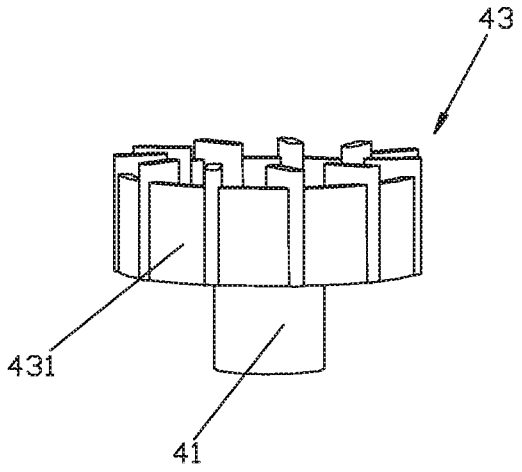
FIG. 6 is the three-dimensional schematic view of the impeller.
Figure 7:
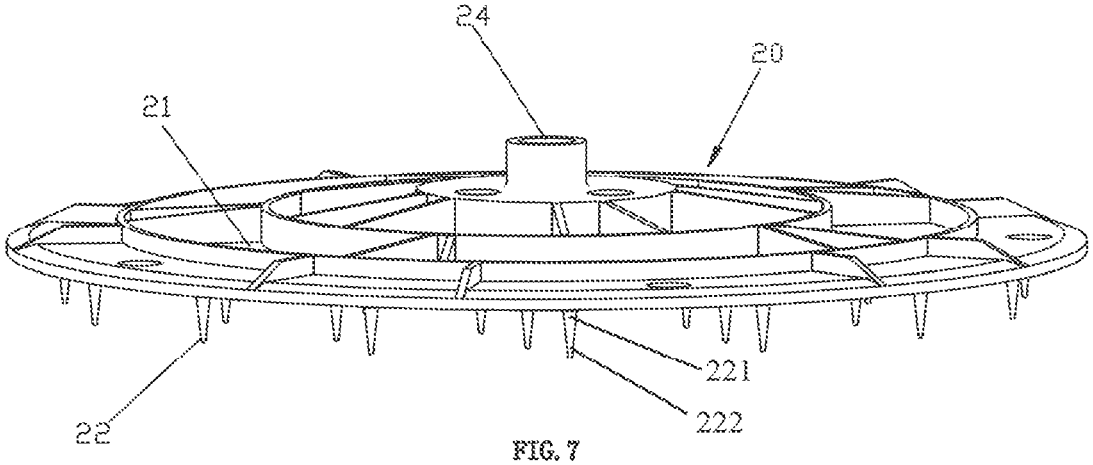
FIG. 7 is the three-dimensional schematic view of the movable portion.
Figure 8:
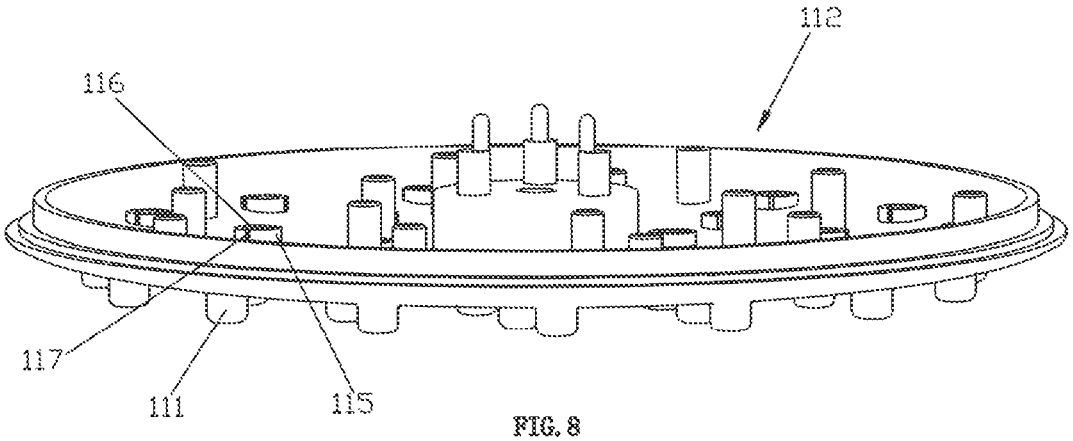
FIG. 8 is a three-dimensional schematic view of the water outlet cover.
Figure 9:
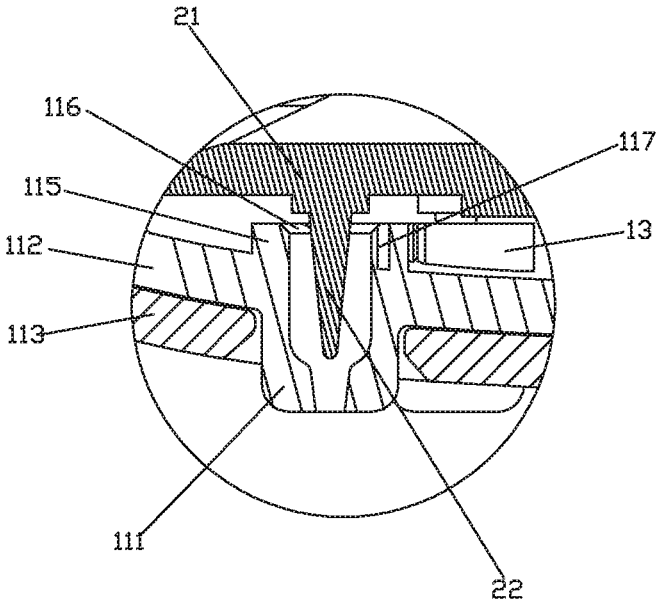
FIG. 9 is an enlarged schematic view of A of FIG. 4.
Figure 10:
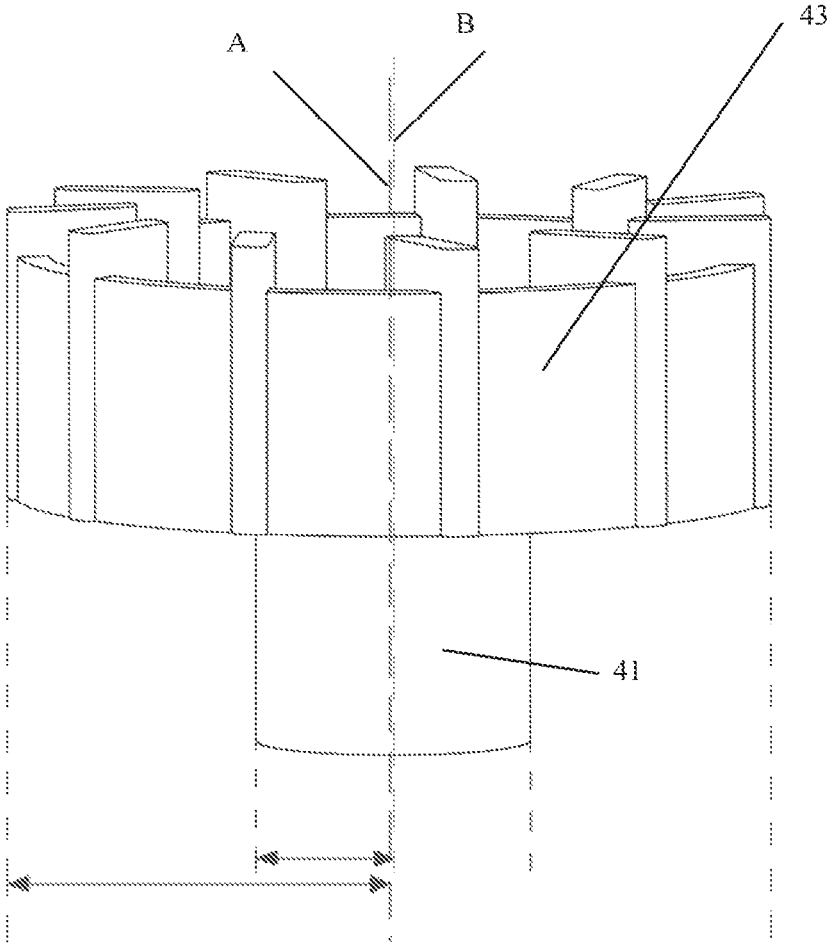
FIG. 10 is a perspective view of the driving mechanism, wherein line A represents a central axis of the driving mechanism, and line B represents a central axis of the cam.

In this embodiment, the spout 111 has a peripheral wall 115 protruding from the back of the water outlet cover 112. An upper port of the peripheral wall 115 forms a first water inlet 116 for connecting the water outlet chamber 13, and the peripheral wall 115 is provided with a second water inlet 117 connecting to the water outlet chamber 13, the second water inlet is an oblique water hole; the protruding portion 22 is inserted into the peripheral wall 115, and the movable plate 21 located at the first position covers the first water inlet 116. First as showed in FIG. 3, the movable portion 20 is in the first position, the movable plate 21 covers the first water inlet 116, the water in the water outlet chamber 13 enters the spout 111 through the second water inlet 117, and the protruding portion 22 is inserted into the spout 111 and forms a ring-shaped chamber between the protruding portion 22 and the spout 111. Under the action of the rotation of the protruding portion 22 around the axis of the spout 111, the water flow in the annular chamber is swirled at a high speed to realize a vortex flow to generate a discrete effect, the shower water state is granular water. Second, as shown in FIG. 4, pressing the button 31 lifts the movable portion 20 up to a second position. The movable plate 21 moves away from the first water inlet 116, at this time, the first water inlet 116 of the end surface of the spout 111 and the second water inlet 117 of the peripheral wall simultaneously feed water, and the influent water of the first water inlet interferes with the swirl of the water from the second inlet, so that the water flow out of the spout 111 form a columnar spray, under the action of the rotation of the protruding portion 22 around the axis of the spout 111, the shower water state is a shaking columnar spray.

In this embodiment, the movable portions are in different positions, and different water sprays can achieve different massage effects to suit different requirements of use. Moreover, different water sprays are discharged from the same spout, different functional water sprays have a same large outlet area. The movable portion is in different position, the water flow is unequal, it can achieve flow regulation. The setting of the movable portion avoids the problem of the residual water of the previous state when the function of the ordinary multi-function shower is switched, and the regular movement of the protruding portion 22 in the spout also removes the deposit of the spout.

The foregoing descriptions are merely exemplary embodiments of the present invention, and therefore, should not be taken as limitations on the scope of the present invention, i.e., equivalent changes and modifications based on the scope of the patent and the contents of the specification should be covered by the present invention range.

The invention claimed is:

1. A shower, comprising:

a fixed portion comprising a water outlet chamber, a movable portion, and a driving mechanism, wherein:

the fixed portion comprises a cover portion comprising a plurality of spouts configured to be connected to the water outlet chamber, the driving mechanism is disposed with a cam configured to rotate relative to the fixed portion and to be operatively connected to the movable portion to drive the movable portion to circulate, the movable portion is disposed in the fixed portion and is configured to at least move in a plane perpendicular to a rotation axis of the movable portion, the movable portion comprises a movable plate and a plurality of protruding portions protruding from the movable plate, the plurality of protruding portions are disposed in the plurality of spouts, the plurality of protruding portions are tapered structures comprising large heads and small tails, each of the plurality of spouts comprises a peripheral wall protruding from a back surface of the cover portion, an upper port of each of the peripheral walls defines a first water inlet configured to be connected to the water outlet chamber, each of the peripheral walls comprises a second water inlet configured to be connected to the water outlet chamber, the plurality of protruding portions are disposed in the peripheral walls, a gap is disposed between each of the plurality of protruding portions and a corresponding one of the plurality of spouts, the movable portion is driven to move at least between a first position and a second position, when the movable portion is in the first position, the plurality of spouts discharge water having a first spray pattern and the movable plate covers the first water inlets, when the movable portion is in the second position, the plurality of spouts discharge water having a second spray pattern different than the first spray pattern, and a height of the first position in a direction parallel to the rotation axis differs from a height of the second position in the direction parallel to the rotation axis.

2. The shower according to claim 1, wherein:

a circulatory movement of the movable portion at least comprises rotation and movement of the movable portion about an eccentric position, and each of the plurality of protruding portions rotates and moves relative to a midline of the corresponding one of the plurality of spouts.

3. The shower according to claim 2, wherein:

the movable plate comprises a matching hole to surround the cam, and the movable portion is driven to slide upward and downward in the direction parallel to the rotation axis along the cam between the first position and the second position.

4. The shower according to claim 1, wherein the second water inlets are oblique water holes.

5. The shower according to claim 1, wherein:

the driving mechanism comprises a hydraulically driven driving mechanism, and the hydraulically driven driving mechanism comprises an oblique water body and an impeller comprising the cam.

6. The shower according to claim 5, wherein:

the fixed portion comprises a water inlet passage configured to be connected to the water outlet chamber, and the driving mechanism is disposed between the water inlet passage and the water outlet chamber.

7. The shower according to claim 1, comprising:

an operating member, wherein:

the operating member is operatively connected to the movable portion, the operating member drives the movable portion to move at least between the first position and the second position, and the operating member comprises a button slidably connected to the fixed portion.

8. The shower according to claim 7, wherein the button is disposed at a center of the cover portion.

9. The shower according to claim 1, wherein:

the fixed portion further comprises a back cover portion, the back cover portion is sealed to the cover portion, and the back cover portion and the cover portion define the water outlet chamber.

10. A shower, comprising:

a fixed portion comprising a water outlet chamber, and a movable portion, wherein:

the fixed portion comprises a cover portion comprising a plurality of spouts configured to be connected to the water outlet chamber, the movable portion is movably disposed in the fixed portion, the movable portion comprises a movable plate and a plurality of protruding portions protruding from the movable plate, the plurality of protruding portions are disposed in the plurality of spouts, the plurality of protruding portions are tapered structures comprising large heads and small tails, a gap is disposed between each of the plurality of spouts and a corresponding one of the plurality of protruding portions, the movable portion is driven to move at least between a first position and a second position, each of the plurality of spouts comprises a peripheral wall protruding from a back surface of the cover portion, an upper port of each of the peripheral walls defines a first water inlet configured to be connected to the water outlet chamber, each of the peripheral walls comprises a second water inlet configured to be connected to the water outlet chamber, the plurality of protruding portions are disposed in the peripheral walls, the movable plate covers the first water inlets when the movable portion is in the first position, and a height of the first position in a direction parallel to a rotation axis of the movable portion differs from a height of the second position in the direction parallel to the rotation axis.

11. The shower according to claim 10, comprising:

an operating member, wherein:

the operating member is operatively connected to the movable portion, the operating member drives the movable portion to move at least between the first position and the second position, and the operating member comprises a button slidably connected to the fixed portion.

12. A shower, comprising:

a fixed portion comprising a water outlet chamber, and a movable portion, wherein:

the fixed portion comprises a cover portion comprising a plurality of spouts configured to be connected to the water outlet chamber, the movable portion is movably disposed in the fixed portion, the movable portion comprises a movable plate and a plurality of protruding portions protruding from the movable plate, the plurality of protruding portions are disposed in the plurality of spouts, the plurality of protruding portions are tapered structures comprising large heads and small tails, each of the plurality of spouts comprises a peripheral wall protruding from a back surface of the cover portion, the plurality of protruding portions are disposed in the peripheral walls, a gap is disposed between each of the plurality of spouts and a corresponding one of the plurality of protruding portions, the movable portion is driven to move at least between a first position and a second position, an upper port of each of the peripheral walls defines a first water inlet configured to be connected to the water outlet chamber, each of the peripheral walls comprises a second water inlet configured to be connected to the water outlet chamber, the second water inlets are oblique water holes, the movable plate covers the first water inlets when the movable portion is in the first position, and a height of the first position in a direction parallel to a rotation axis of the movable portion differs from a height of the second position in the direction parallel to the rotation axis.

13. The shower according to claim 12, comprising:

an operating member, wherein:

the operating member is operatively connected to the movable portion, the operating member drives the movable portion to move at least between the first position and the second position, and the operating member comprises a button slidably connected to the fixed portion.

14. A shower, comprising:

a fixed portion comprising a water outlet chamber, a movable portion, and a driving mechanism, wherein:

the fixed portion comprises a cover portion comprising a plurality of spouts configured to be connected to the water outlet chamber, the movable portion is movably disposed in the fixed portion, the movable portion comprises a movable plate and a plurality of protruding portions protruding from the movable plate, the plurality of protruding portions are disposed in the plurality of spouts, the plurality of protruding portions are tapered structures comprising large heads and small tails, each of the plurality of spouts comprises a peripheral wall protruding from a back surface of the cover portion, an upper port of each of the peripheral walls defines a first water inlet configured to be connected to the water outlet chamber, each of the peripheral walls comprises a second water inlet configured to be connected to the water outlet chamber, the plurality of protruding portions are disposed in the peripheral walls, a gap is disposed between each of the plurality of spouts and a corresponding one of the plurality of protruding portions, the driving mechanism is disposed with a cam configured to rotate relative to the fixed portion and to be operatively connected to the movable portion to drive the movable portion to circulate and move between a first position and a second position, the movable plate covers the first water inlets when the movable portion is in the first position, a circulatory movement of the movable portion at least comprises rotation and movement of the movable portion about an eccentric position in a plane perpendicular to a rotation axis of the movable portion, and each of the plurality of protruding portions rotates and moves relative to a midline of a corresponding one of the plurality of spouts.

* * * * *